US007789008B2

(12) United States Patent
Petersen

(10) Patent No.: US 7,789,008 B2
(45) Date of Patent: Sep. 7, 2010

(54) ENERGY SUPPRESSORS

(76) Inventor: Byron S. Petersen, 39545 Upper Camp Creek Rd., Springfield, OR (US) 97478

( * ) Notice: Subject to any disclaimer, the term of this patent is extended or adjusted under 35 U.S.C. 154(b) by 206 days.

(21) Appl. No.: 11/127,627

(22) Filed: May 12, 2005

(65) Prior Publication Data

US 2010/0180759 A1 Jul. 22, 2010

(51) Int. Cl.
*F41A 21/30* (2006.01)

(52) U.S. Cl. ..... 89/14.4

(58) Field of Classification Search ..... 89/14.4
See application file for complete search history.

(56) References Cited

U.S. PATENT DOCUMENTS

| | | | | | |
|---|---|---|---|---|---|
| 944,646 | A * | 12/1909 | Xardell | 181/275 |
| 1,207,264 | A | 12/1916 | Bailey | |
| 1,736,319 | A * | 11/1929 | Maxim | 181/267 |
| 2,192,081 | A | 2/1940 | Hughes | |
| 2,449,571 | A | 9/1948 | Walker | |
| 3,707,899 | A | 1/1973 | Perrine | |
| 3,713,362 | A * | 1/1973 | Charron | 89/14.4 |
| 3,786,895 | A * | 1/1974 | Perrine | 181/223 |
| 4,530,417 | A | 7/1985 | Daniel | |
| 4,576,083 | A | 3/1986 | Seberger, Jr. | |
| 4,907,488 | A * | 3/1990 | Seberger | 89/14.4 |
| 4,974,489 | A | 12/1990 | Fishbaugh | |
| 5,679,916 | A | 10/1997 | Weichert | |
| 5,773,746 | A * | 6/1998 | Vaden | 89/14.4 |
| 6,308,609 | B1 * | 10/2001 | Davies | 89/14.4 |
| 6,374,718 | B1 * | 4/2002 | Rescigno et al. | 89/14.4 |
| 6,425,310 | B1 * | 7/2002 | Champion | 89/14.3 |
| 6,575,074 | B1 * | 6/2003 | Gaddini | 89/14.4 |
| 6,701,820 | B2 | 3/2004 | Fluhr | |
| 6,796,214 | B2 * | 9/2004 | Hausken et al. | 89/14.4 |
| 6,899,008 | B2 * | 5/2005 | Breuer | 89/14.3 |
| 2005/0126382 | A1 * | 6/2005 | Yoshimura et al. | 89/14.4 |
| 2006/0060076 | A1 * | 3/2006 | Dueck et al. | 89/14.4 |

* cited by examiner

*Primary Examiner*—Troy Chambers
(74) *Attorney, Agent, or Firm*—Vincent L. Carney

(57) ABSTRACT

A suppressor for a firearm includes a first gas expansion section of relatively large size sufficient to reduce the temperature and pressure of the gas expelled from a muzzle during discharge of the firearm to a level that avoids rapid degrading of structural members such as baffles in the suppressor that are downstream of the muzzle. The gas is channeled through multiple paths to distribute its energy more equally. Preferably, the suppressor is formed with a lightweight, thermally-conductive composite portion. The composite portion provides lightweight, bursting strength with good thermal conductivity and little contribution to vibrational instability of the muzzle to which it is attached. The composite portion may be of a carbon fiber, silicon, boron, or metallic base. In one embodiment, a first expansion chamber is in communication with the muzzle and with a second expansion chamber and in another embodiment, the first expansion chamber communicates with the muzzle and with the second expansion chamber The composite portions of the suppressor provide good bursting strength and heat conductivity with light weight. In some embodiments, a series of baffles creates turbulence in the gas, slowing its motion and distributing the energy more evenly over space.

8 Claims, 8 Drawing Sheets

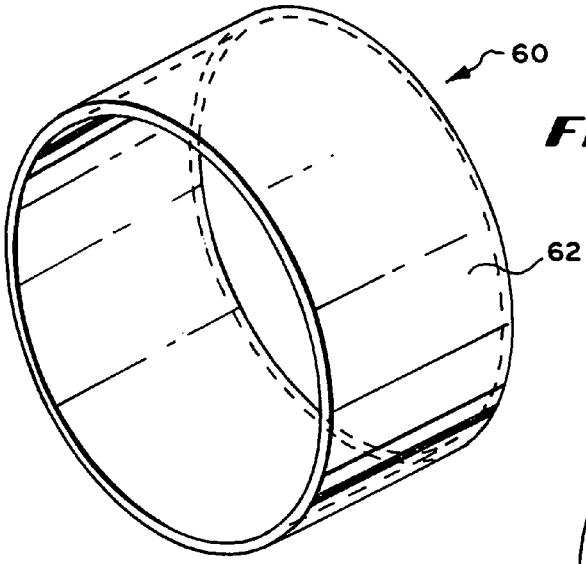
FIG. 9
FIG. 10
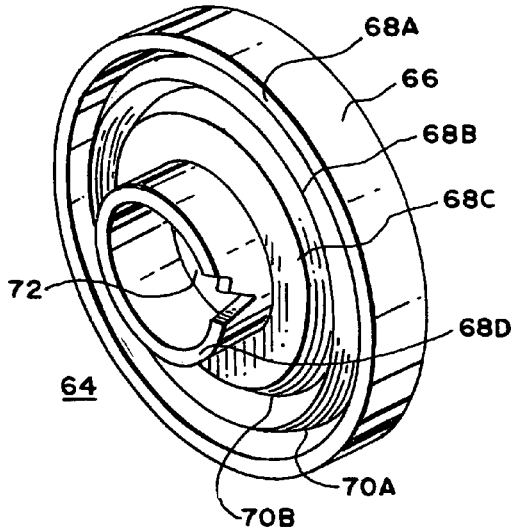
FIG. 11
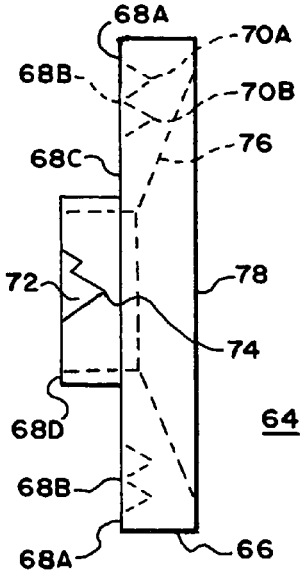
FIG. 12
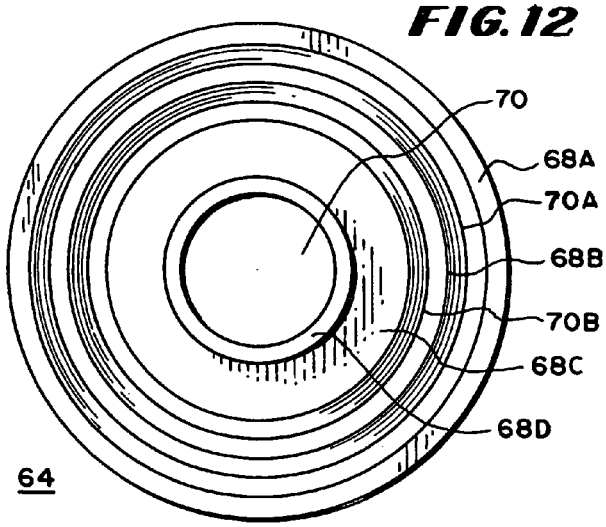

ENERGY SUPPRESSORS

BACKGROUND OF THE INVENTION

This invention relates to energy suppressors such as silencers including energy suppressors using composite structures.

It is known to reduce the report of firearms by leveling the energy from firing over time and space. This is done by channeling the gas formed by firing the firearm through a series of compartments and/or pathways. The gas is expanded in the chambers and pathways in a manner that slows its motion in any one direction and its energy absorbed by solid objects with a slower response time such as baffles along some of the pathways. Moreover, energy that is in the form of heat is dissipated in space with minimum of rapid thermal expansion of gas that would otherwise increase the velocity of the gas in a single direction. In this manner, the energy from the explosion is spread in time and space to reduce the intensity of sound caused by the sudden forced motion of air propelled by the energy.

In one prior art sound suppresser or silencer, the gas is channeled from the muzzle along a longitudinal path where it passes through radial openings into a series of interconnected compartments within an outer tube. The barrel of the firearm extends into a seat within the silencer and the series of compartments extends both forward and rearwardly so some of them are located around the barrel and others forward of the barrel. The compartments over the barrel reduce the length the silencer adds to the firearm. One such prior art suppressor is disclosed in United States patent publication 20030145718. In the prior art noise suppressors, the tube into which the gas is directed is broken in multiple equal sized chambers. This type of noise suppressor has several disadvantages, such as: (1) the gas in the first chamber is high energy and tends to degrade the material of baffles; (2) the first radial opening and baffle is close to the muzzle and receives gas under high pressure and temperature which tends to degrade it; (3) the radial openings into the upper tube are small and spaced, resulting in slow increases in the area of movement with resulting slow reduction in energy density; (4) there are relatively few changes in direction of motion; and (5) no special measures are taken to increase heat transfer to increase the area of heat reception and decrease temperature with resulting thermal contraction of gas.

It is also known to construct strong, light structures using composite materials that may be advantageous to disperse thermal energy in energy suppressors.

Known thermally conductive composite structures include thermally conductive primary metallic base metals and other materials such as titanium metallic materials, carbon fiber based materials, and exotic metals. Examples of thermally-conductive composite structures are disclosed in U.S. Pat. No. 6,284,389 to Jones et al., granted Sep. 4, 2001 and in United States publication U.S. 2004-0244257-A1, published Dec. 9, 2004 in the name of Michael K. Degerness. However, such composite materials have not been used in conjunction with energy suppressors although the need for controlling the heating of energy suppressors has long been known and thermally conductive materials have long been known.

SUMMARY OF THE INVENTION

Accordingly, it is an object of the invention to provide a novel sound suppressor or silencer.

It is a further object of the invention to provide a novel method of making and using a noise suppressor.

It is a still further object of the invention to provide a noise suppressor that does not add substantial length to the firearm.

It is a still further object of the invention to provide a silencer that is relatively light in weight.

It is a still further object of the invention to provide a silencer suitable for use with rapid cycling firearms.

It is a further object of the invention to provide a novel composite structure.

It is a still further object of the invention to provide a novel composite structure with superior noise suppression characteristics.

It is a still further object of the invention to provide a novel firearm suppressor that avoids both excessive weight, size and overheating, while providing accuracy.

It is a still further object of the invention to provide a novel suppressor with composite materials that provide superior heat transfer, pressure reduction and vibrational characteristics.

It is a still further object of the invention to provide a novel suppressor that combines both lightweight and high internal volume.

It is a still further object of the invention to provide a novel suppressor with a superior ability to reduce the outlet pressure of discharge gases.

In accordance with the above and further objects of the invention, an energy suppressor for a firearm includes a first gas expansion section of relatively large size sufficient to reduce the temperature and pressure of the gas expelled from the muzzle during discharge of the firearm to a level that avoids rapid degrading of structural members such as baffles in the suppressor that are downstream of the muzzle. The gas is channeled through multiple paths to distribute its energy. Preferably, the suppressor is formed with a lightweight, thermally-conductive material positioned to increase the energy dissipation and angular stability of the suppressor under stress and reduce the noise emitted by it. The composite portion provides light-weight bursting strength with good thermal conductivity and little contribution to vibrational instability of the firearm to which it is attached.

In one embodiment, the suppressor includes at least first and second energy spreading sections. The first energy spreading section has a first expansion chamber in communication with the muzzle. The first expansion chamber is of sufficient size to reduce the energy density of gases formed by discharge of the firearm to a temperature and pressure that avoids the deterioration of the structural members such as downstream baffles. The lower energy density gas from the first expansion chamber is transmitted to the second energy spreading section. The second energy spreading section includes at least a second expansion chamber that extends back from the muzzle so that it is at least partly extends rearward of the muzzle. This shortens the overall length of the firearm and silencer combination. The composite portions of the suppressor, combined with the mechanical design, provide good bursting strength and heat conductivity with light weight. In some embodiments, a series of baffles create turbulence in the gas, slowing its motion and distributing the energy more evenly over space.

In another embodiment, the gases from the muzzle flow through a coupling that is large enough to reduce the energy density to the first energy spreading section which is an elongated passageway leading forward from the muzzle with a series of baffles. Openings in the first energy spreading section permit the escape of gas into a second energy spreading section. The second energy spreading section includes an expansion chamber which may, in one embodiment, extend rearwardly from the muzzle so that a substantial portion of the barrel is seated in the suppressor. At least some of the walls of the suppressor may be composites that include conductive carbon wall portions.

In one embodiment, the discharge gas enters an inner tube where it expands and flows: (1) through baffles that cause the hot pressurized gas to follow multiple paths by causing turbulence; and (2) through perforations along the length of the inner tube into an outer tube. The first baffle contacted by the hot pressurized gas should be at least 20 percent further from the muzzle than the average distance between baffles so that the gas has expanded and cooled before hitting the first baffle. The distance to the second baffle may also be longer in some embodiments. The inner tube and baffles as well as the outer tube may be of the lightweight conductive material such as conductive carbon fibers embedded in resin. In one embodiment, the conductive material is comprised of a plurality of randomly oriented discontinuous heat conductive fibers embedded in the resin. The walls that are subject to internal outwardly-directed pressure such as the outer and inner tube walls may include tows with the resin carbon fiber composite for bursting strength. The distance the hot pressurized gas travels and expands before hitting the first degradable member, such as a baffle, should be at least 20 percent greater than the distance between any two baffles. Because the gas in the outer tube has expanded more than the gas in the inner tube, it will be cooler in temperature. The temperature difference can be controlled during design by selecting the volume and the paths through which the gas flows into each tube. For efficient heat transfer, half of the drop in temperature should be between the inner tube and the second tube and half between the outer tube and ambient temperature.

From the above description, it can be understood that the energy suppressor and/or combination of the energy suppressor and firearm of this invention and the methods of making them have several advantages, such as: (1) they reduce the amplitude of the report of the firearm with a smaller increase in length of the combined firearm and silencer and a small increase in weight; (2) they increase the life of the suppressor by reducing deterioration of the baffles from the hot gases; (3) they improve accuracy and reduce the amplitude of vibrations at the muzzle; (4) they aid in the dissipation of heat and reduce the tendency of the energy suppressor to overheat; and (5) they can be manufactured reliably and predictably with desirable characteristics in an economical manner.

BRIEF DESCRIPTION OF THE DRAWINGS

The above noted and other features of the invention will be better understood from the following detailed description when considered in connection with the drawings in which:

FIG. 9 is a perspective view of a cylindrical spacer;

FIG. 10 is a perspective view of a baffle, which together with the spacer of FIG. 9 forms one unit of a spacer baffle combination in accordance with an embodiment of the invention;

FIG. 11 is a side elevational view of the baffle of FIG. 10 in accordance with an embodiment of the invention;

FIG. 12 is a top view of the baffle of FIG. 10 in accordance with an embodiment of the invention;

DETAILED DESCRIPTION

Figure 1:
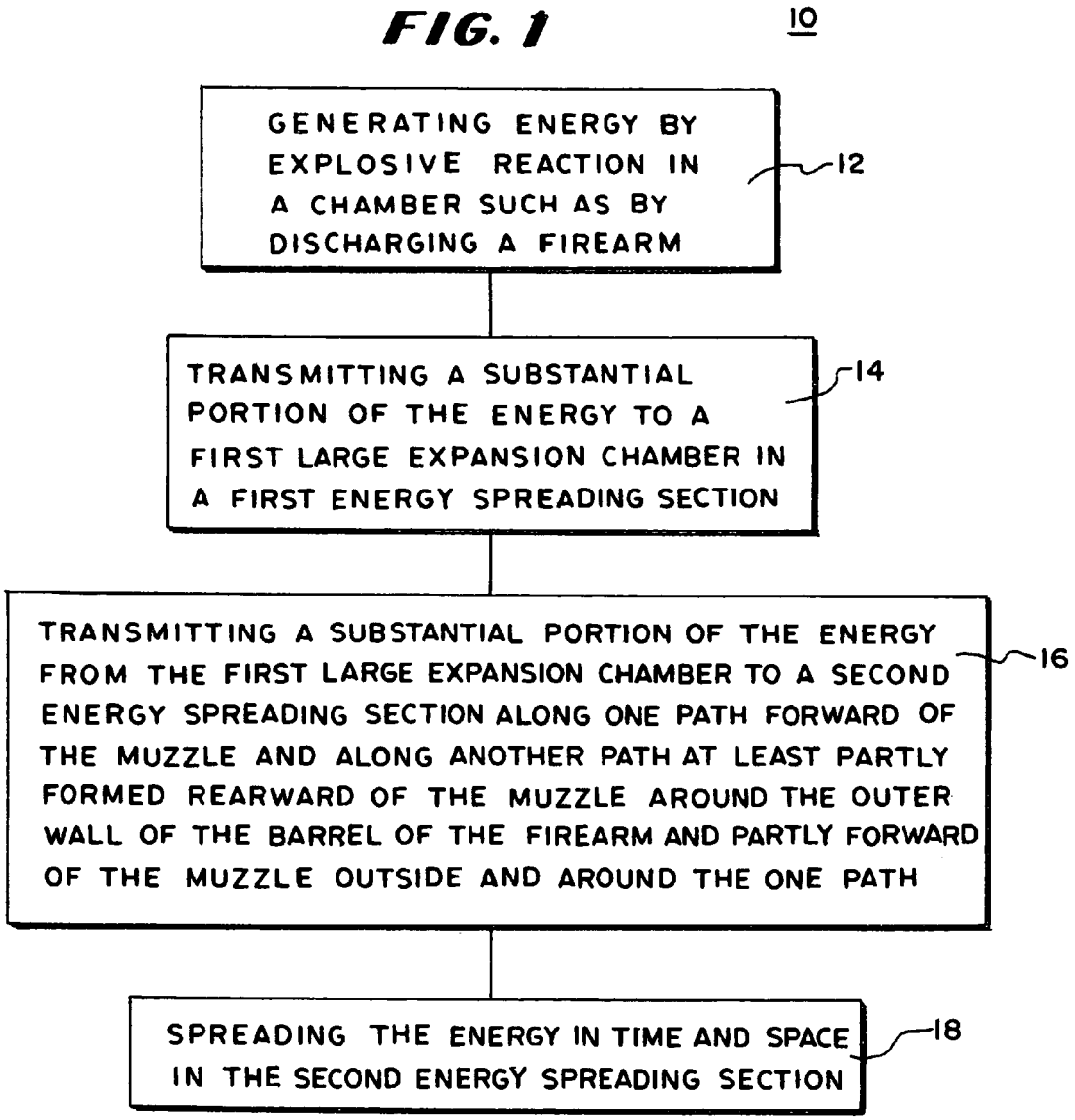
FIG. 1 is a flow diagram of a process of using an energy suppressor in accordance with an embodiment of the invention.

In FIG. 1, there is shown a flow diagram of a process 10 of firing a firearm utilizing a silencer in accordance with an embodiment of the invention including the step 12 of generating energy by explosive reaction in a chamber such as by discharging a firearm; the step 14 of transmitting a substantial portion of the energy to a first large expansion chamber which functions as a first energy spreading section, the step 16 of transmitting a substantial portion of the energy from the first large expansion chamber to a second energy spreading section; and the step 18 of the first large expansion chamber rapidly spreading the energy in time and space within the central longitudinal axis of the silencer to reduce the temperature and pressure of the gas from discharge before it contacts the baffles or other solid members than can be degraded excessively by the heat and pressure.

In this specification, the term "energy spreading" means increasing the area over which energy is acting kinetically or the time over which it is acting kinetically to create sound so as to reduce the amplitude of the sound leaving a confined system. The term "expansion chamber" means a space bounded at least in part by walls that hinder motion or slow motion; which chamber is larger than the volume of the gas entering it so that the gas expands to reduce its pressure and/or temperature. Energy density means the enthalpy in a system defined by a fixed volume (e.g. enthalpy per square inch).

The second energy spreading section provides a first passageway 25 and a second passageway 27 for the hot gases to spread the energy over time and further spread the energy over space before it causes a sonic effect outside the silencer. The first passageway 25, which surrounds the barrel, the first large expansion chamber and the second passageway 27 receive the hot gases from the first large expansion chamber with which they communicate at the muzzle and channels the hot gases over the second passageway 27. The hot gases are cooled by conduction through high thermal conductivity walls on the suppressor.

Figure 2:
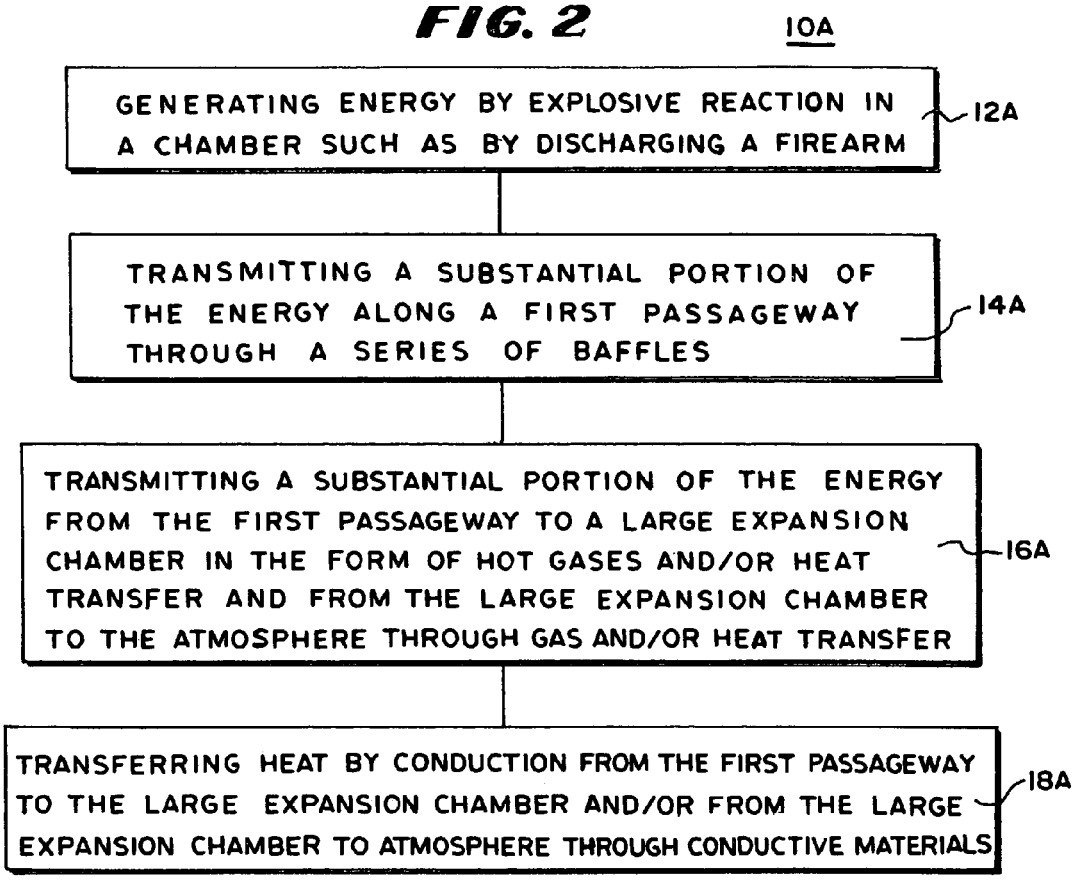
FIG. 2 is a flow diagram of another process of using an energy suppressor in accordance with an embodiment of the invention.

In FIG. 2, there is shown a flow diagram of a process 10A of firing a firearm utilizing a silencer in accordance with another embodiment of the invention including the step 12A of generating energy by explosive reaction in a chamber such as by discharging a firearm; the step 14A of transmitting a substantial portion of the energy along a second passageway 27 through a series of baffles, the step 16A of transmitting a substantial portion of the energy from the second passageway 27 to a large expansion chamber in the form of hot gases and/or heat transfer and from the large expansion chamber to the atmosphere through gas and/or heat transfer; and the step 18A of transferring heat by conduction from the second passageway 27 to the large expansion chamber and/or from the large expansion chamber to atmosphere through highly conductive material. The highly conductive material may be but is not limited to highly conductive metal, metal composites, carbon composites, and other such suitable materials.

The energy from the discharge passes through a series of baffles, spacers and openings from the muzzle to the end of the silencer where the projectile exits the silencer. At each opening, hot gas flows into a large expansion chamber that reduces its energy density and delays and spreads over a larger area than the pressure surge, thus weakening the effect of the report of a firearm or other explosive source of sound. In the large expansion chamber, heat is transferred through highly conductive thermal walls, and in some embodiments heat may be conducted into the large expansion chamber from baffles and spacers in the first passageway 25 through highly conductive material.

Figure 3:
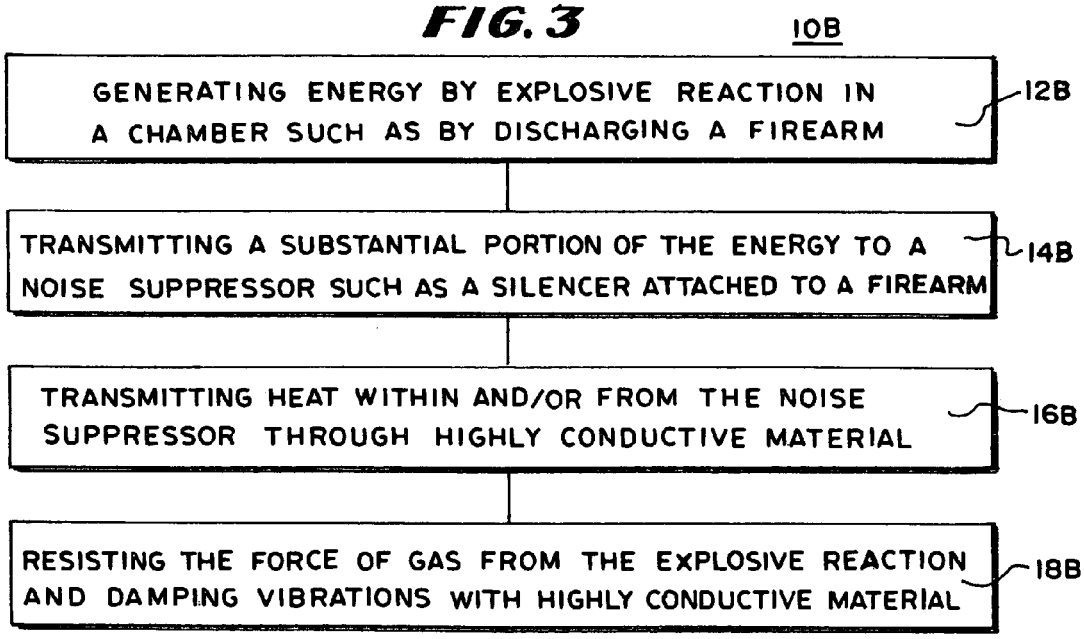
FIG. 3 is a flow diagram of still another process of using an energy suppressor in accordance with an embodiment of the invention.

In FIG. 3, there is shown a flow diagram of a process 10B of firing a firearm utilizing a silencer in accordance with still another embodiment of the invention including the step 12B of generating energy by explosive reaction in a chamber such as by discharging a firearm; the step 14B of transmitting a substantial portion of the energy to a noise suppressor such as a silencer attached to a firearm, the step 16B of transmitting heat within and/or from the noise suppressor through high thermal conductivity material, and the step 18B of resisting the force of gas from the explosive reaction.

Figure 4:
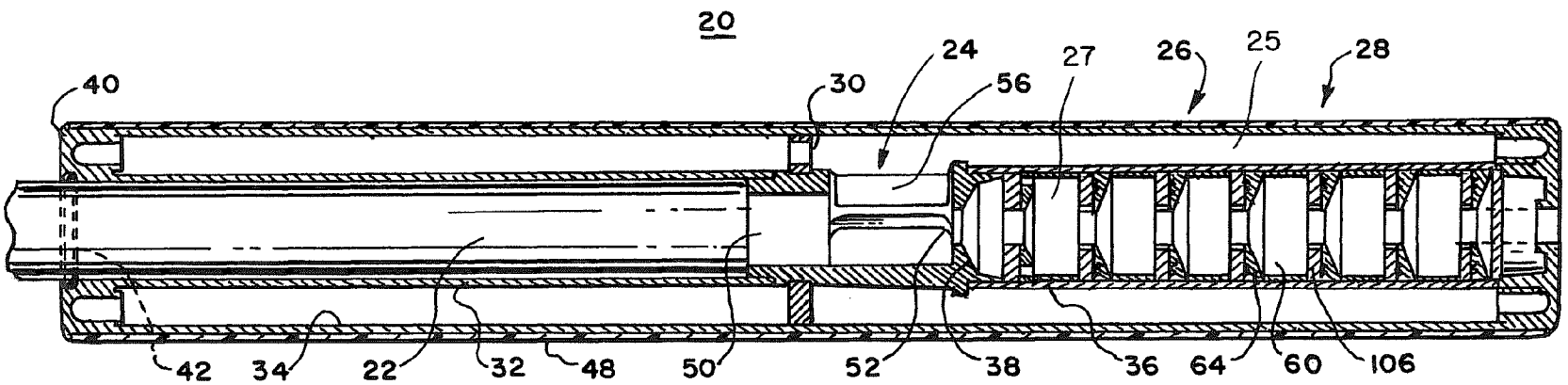
FIG. 4 is a fragmentary perspective view of a suppressor mounted to a barrel of a firearm partly broken away to show the structure of the baffles in the suppressor and the barrel of the firearm in accordance with an embodiment of the invention.

In FIG. 4, there is shown at 20 a fragmentary, simplified, perspective view of a firearm equipped with a silencer 28, partly broken away, to illustrate the seating within the silencer 28 of the barrel 22 of the firearm. The silencer 28 has as its principal parts a first energy spreading section 24, a second energy spreading section 26, a central support 30, a rear end cap 40 and a front end cap 44 (not shown in FIG. 4, see FIG. 5). The rear end cap 40 compresses an O-ring 42 against the barrel 22 to seal the barrel and the silencer 28 and to provide support together with the central support 30. The front end cap 44 (FIG. 5) holds a front spacer 46 (not shown in FIG. 4, see FIG. 5) within the second energy spreading section 26. To mount the barrel 22 and the silencer 28 together, the cylindrical central support 30 receives the barrel 22 in the central opening and receives the inner surfaces of a front tube 36 and a rear tube 32.

The first energy spreading section 24 is a hollow body with central and radial openings. The central openings communicate with the end of the muzzle through a first couple on a first end 50 of the first energy spreading section 24 and a second axially located passageway 27 of the second energy spreading section 26 through a second couple on a second end of the first energy spreading section 24. The radial openings communicate with a first passageway 25 of the second energy spreading section 26. The first passageway 25 is between the outer surface of the front and rear tubes 36 and 32 and the inner surface of an outer tube 34 which extends the length of the silencer 28 and has the high thermal conductivity outer wrap 48 over it. With this arrangement, the hot gas from the muzzle is first expanded in the first energy spreading section 24 to reduce the energy density and than applied most directly to the first passageway 25 with part being over the barrel 22 and the front end of the second axial passageway 27. The second couple communicates with the first energy spreading section 24 and the second passageway 27.

The second energy spreading section 26 includes the outer tube 34, the outer tube wrap 48, the rear tube 32 and the front tube 36 formed between the outer tube 34 and a plurality of axially-aligned spacer-baffle combinations one unit of which is labeled at 38. The spacer-baffle combinations shown at 38 also receive hot gases from the first energy spreading section 24.

With this combination, hot gases from the muzzle of the barrel 22 exit into the first expansion chamber which is within the first energy spreading section 24 and from there moves along the rear tube 32 where it expands further and dissipates heat through the outer tube 34 and wrap 48. The wrap 48 is a special thermally-conductive, high-bursting strength composite layer. The hot gas also expands forward through the second passageway 27 where turbulence is created by the spacer-baffle combinations 38.

For the purpose of creating turbulence and spreading the energy in time and space, the spacer-baffle combinations 38 include a compression ring 106, a baffle 64 and a spacer 60 shown for one spacer-baffle combination in FIG. 4. The compression ring 106 receives hot gases under pressure through a plurality of circumferentially spaced openings (not shown in FIG. 4, see FIG. 14) and creates pressure against the face of the baffle 64 which receives it in a series of grooves and walls. In some embodiments, gas from a central passageway through which the projectile passes also enters the space between the compression ring 106 and baffle 64. The spacer 60 separates the units 38 of the spacer-baffle combination.

In this operation, the hot gases generated by discharge of the firearm drive the projectile through the barrel 22 after which the projectile moves along the longitudinal axis of the silencer 28 through a first expansion chamber and a second pathway through the center openings about the spacer-baffle combinations 38 while the hot gases flow into the first expansion chamber and then along the first and second pathways of the second energy spreading section 26. The energy density is reduced in the first energy expansion station by expansion of the gases and then the gas after being cooled and reduced in pressure in the first energy spreading section 24 divides into two pathways in proportion to the size of the openings between the first energy spreading section 24 and a first passageway 25 and between the first energy spreading section 24 and the second passageway 27.

Because the opening between the first energy spreading section 24 and the second passageway 27 is smaller than the opening between the first energy spreading section 24 and the first passageway 25, a smaller portion of the hot gas flows into the second passageway 27 where it is expanded in a relatively large area, mixed by baffles and slowed before exiting the end of the silencer 28. The baffle-spacer combinations 38 include surfaces that are contoured to cause swirling motion of the gases to reduce pressure in any one direction at the same time. The majority of the hot gas flows into the first passageway 25 which expands the gas and distributes it over the circumference of the silencer 28. A portion of the energy is transferred by conduction to the outer surface of the silencer 28 and removed from there by radiation and convection, thus reducing the temperature of the gases and correspondingly the thermal expansion. The second passageway 27 is resistant to degrading by heat and pressure. The inner surface of the second passageway 27 is partly the barrel's outer surface and the outer surface of the outer wall. Its outer surface is the inner surface of the outer tube 34. Heat is transferred through the highly heat conductive outer wrap 48.

Figure 5:
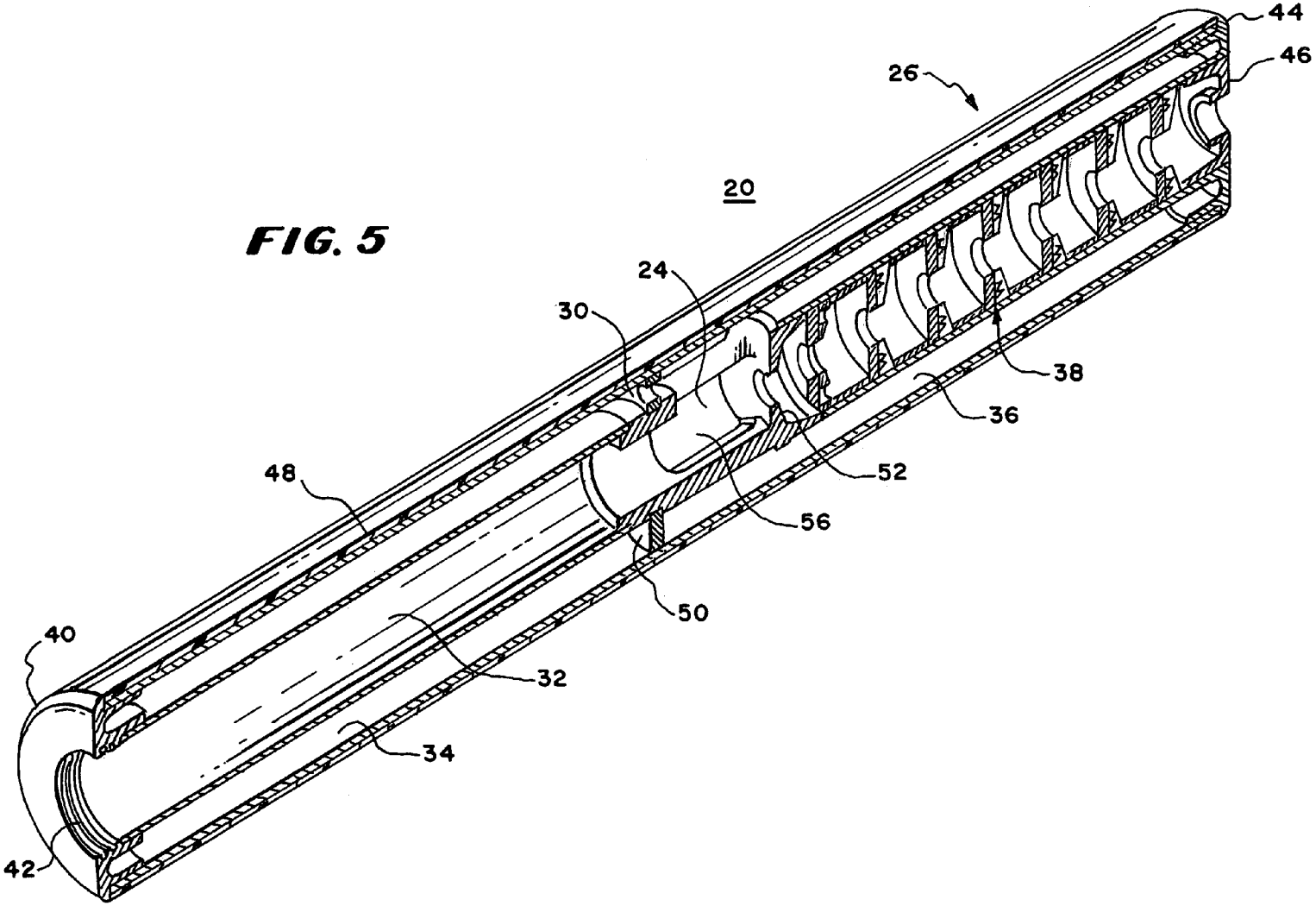
FIG. 5 is a broken away perspective view of a silencer without the rifle barrel in place to show a rear tube, a front tube, an outer tube, a series of baffle-spacer combinations and a first expansion chamber.

In FIG. 5, there is shown at 20 a broken away perspective view of the silencer 28 without the rifle barrel in place having the rear tube 32, the front tube 36, the outer tube 34, the baffle-spacer combinations 38 forming the second energy spreading section 26 and having the first energy spreading section 24 with the enlarged cylindrical portion 54, first coupling end 50 and outlet coupling 52 of the first expansion chamber. As best shown in this view, an end cap 40 having an O-ring 42 engaging the barrel 22 seals one end with the barrel being seated within the front tube 34. A front end cap 44 closes the front end against the barrel 22 and is separated from the baffle-spacer combination 38 by a front spacer 46. The front spacer 46 is a right regular tubular cylinder. As best shown in this view, the central support 30 connects the inlet coupling 50 of the first energy spreading section 24 to the interior of the outer tube 34 at the central location that permits the gases from the first energy spreading section 24 to pass between the outer tube 34 and the rear tube 32 and the front tube 36.

Figure 6:
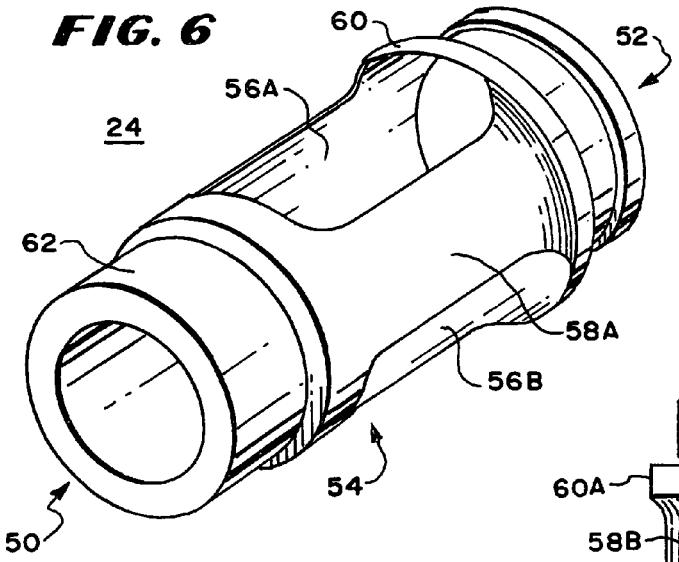
FIG. 6 is a simplified perspective view of one embodiment of a first energy spreading section.

In FIG. 6, there is shown a simplified perspective view of one embodiment of the first energy spreading section 24 having the inlet coupling 50, the outlet coupling 52 and the enlarged central cylindrical section 54 in communication with each other. The enlarged section 54 includes a plurality of openings 56A and 56B being shown for illustration separated by web portions 58A being shown as an example. With this arrangement, the hot gases exiting the muzzle flow into the inlet coupling 50 and principally out of the openings 56A and 56B into the first passageway 25 of the second energy spreading section 26 (FIGS. 4 and 5) and out of the outlet coupling 52 into the second passageway 27 of the second energy spreading section 26. A collar 62 engages the end of the muzzle and an enlarged cylindrical portion 60 closes the front tube 34 (FIGS. 4 and 5) with the open end extending into the second passageway 27 of the second energy spreading section 26.

Figure 7:
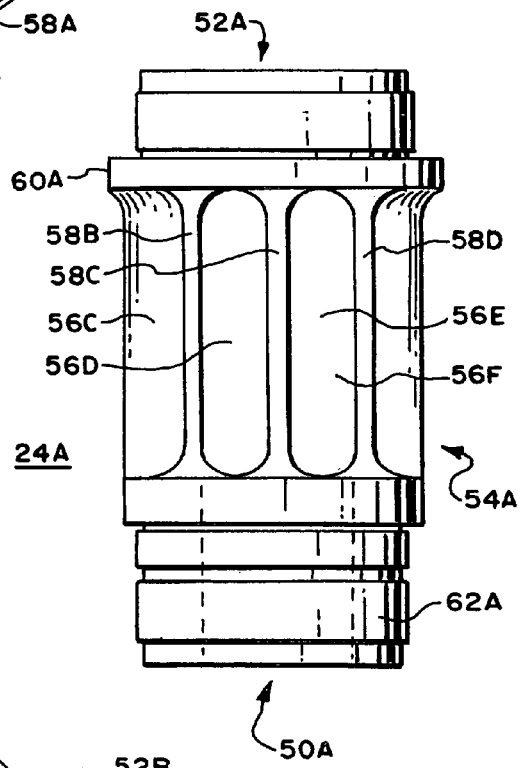
FIG. 7 is a side elevational view of another embodiment of the first energy spreading section.

In FIG. 7, there is shown a side elevational view of another embodiment of the first energy spreading section 24A having an inlet coupling 50A, its outlet coupling 52A and a plurality of openings 56C-56F in an enlarged cylindrical section 54A separated by web portions 58B-58D identified by reference numbers that are the same for corresponding parts as the reference numbers used in the embodiment of FIG. 6. The inlet coupling section 50A is sized to receive and seat the barrel 22 and the outlet coupling 52A is sized to couple with the forward end of the silencer 28. Two enlarged cylindrical radially outwardly extending portions 60A and 62A engage the inner walls of the outer tube 34 (FIGS. 4 and 5) of the second energy spreading section 26A (FIGS. 5 and 6) and serve as central supports therefore.

Figure 8:
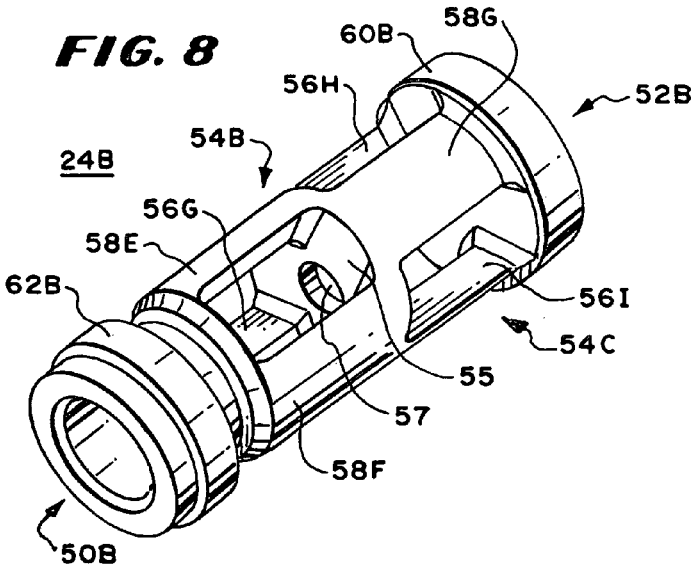
FIG. 8 is a simplified perspective view of still another embodiment of the first energy spreading section.

In FIG. 8, there is shown a simplified perspective view of still another embodiment of the first energy spreading section 24B having first and second enlarged cylindrical sections 54B and 54C divided by a wall 55 having a reduced opening 57 through it, an inlet coupling 50B, an outlet coupling 52B, a first plurality of openings one of which is shown at 56G in the first enlarged cylindrical section 54B, separated by a corresponding set of web portions 58E and 58F being shown in FIG. 8 as examples, a second plurality of openings 56H and 56I being shown in FIG. 8, separated by corresponding ones of the web sections 58G and 58H (not shown in FIG. 8). The inlet coupling section 50B is sized to receive and seat the barrel 22 and the outlet coupling 52B is sized to couple with the forward end of the silencer 28. Two enlarged cylindrical radially outwardly extending portions 60B and 62B engage the inner walls of the outer tube 34 of the second energy spreading section 26 (FIGS. 5 and 6) and serve as central supports therefore. In this embodiment, a further delay is provided by the two separated compartments 54B and 54C, with 54B receiving the hottest, higher pressure gas first and the compartment 54C receiving lower pressure, cooler gas slightly later to further spread the energy and resulting pressure waves in space and time.

In FIG. 9, there is shown a perspective view of a cylindrical spacer 60 and in FIG. 10 there is shown a perspective view of a baffle 64, which together form one unit of the spacer-baffle combination 38 (FIGS. 4 and 5). The spacer 60 is a tubular right regular cylinder having a thin wall 62. The baffle 64 is shaped as a plurality of radially spaced peaks and grooves with the projectile path being through the center so as to receive hot gases in the grooves at an angle and cause delay and turbulence in the gases. The baffle 64 has an outer right regular cylindrical wall 66 ending in the first and outer peak 68A of four circumferentially spaced peaks 68A-68D. The center and last peak 68D is shaped as a right regular cylinder surrounding a central opening 72 through which the projectile passes. The peaks 68A-68C are spaced apart by two circumferentially-spaced grooves 70A and 70B defined by slanting sides of the peak between them. The peaks 68A-68C face the muzzle.

In one embodiment, the spacer 60 has the same outer diameter as the inner diameter of the peak edge 68D surrounding the central opening 72 in the baffle 64 so that the spacers and inner wall of the central opening 72 form a passageway for the projectile. Radial openings such as that shown at 74 in the inner wall around the central opening 72 permit the escape of gas from the central passageway for the projectile and into the second passageway 27 of the silencer. In another embodiment, the spacer 60 has the same outer diameter as the outer diameter of the first and outer peak 68A to form an outer wall of the second passageway 27 that overlies the inner wall of the front tube 36 (FIGS. 4 and 5) so as to leave larger spaces for the gas from the muzzle to impinge on the baffles. In both embodiments, a plurality of alternately positioned spacers 60 and baffles 64 align axially with each other and forms an elongated right regular cylinder which is the baffle-spacer combination 38 of the second passageway 27 of the second energy spreading section 26 (FIGS. 4 and 5). The number of spacers and baffles and their size are selected for the particular application of firearm.

In FIG. 11, there is shown a side elevational view of the baffle 64 having the cylindrical outer wall 66, the peaks 68A-68D and the central opening 72. As best shown in this view, the peak 68C is flat between the groove 70B and the cylinder 68D. The side of the baffle 64 that faces away from the muzzle has a truncated cone shaped cavity intersecting the cylinder 72.

In FIG. 12, there is shown a top view of the baffle 64 illustrating the grooves 70A and 70B with hidden lines for clarity. While a specific type of baffle is shown in FIGS. 10-12, any configuration to achieve this purpose may be used to cause the hot gases to follow an irregular path and thus spread in time and space the effect of the gas pressure.

Figure 13:
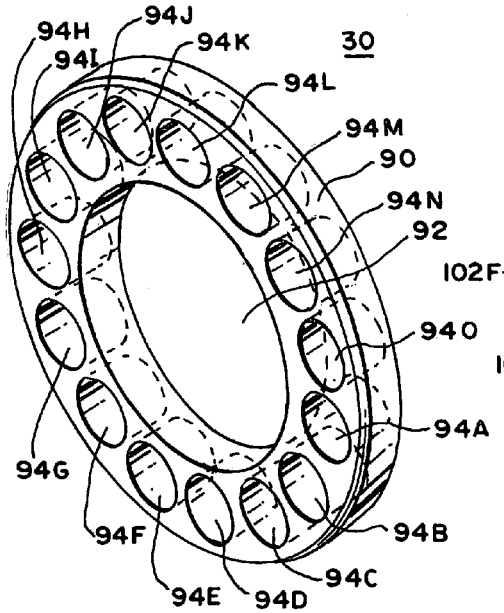
FIG. 13 is a perspective view of a central support in accordance with an embodiment of the invention.

In FIG. 13, there is shown a perspective view of a central support 30 having a generally cylindrical shape with a cylindrical outer surface 90 that rests against the outer wall and a central opening 92 which fits around the second passageway 27 of the second energy spreading section 26 to engage the dividing location between the front and rear inner walls. It is relatively thin and orthogonal to the outer wall having a plurality of circumferentially spaced openings 94A-94O, which are cylindrical and aligned with the axis of the silencer 28 to permit gaseous flow throughout the circumference between the barrel side of the first passageway 25 and the forward side of the first passageway 25 of hot gases from the first energy spreading section 24. This central support 30 also supports the outer wall besides spacing the outer and inner walls.

Figure 14:
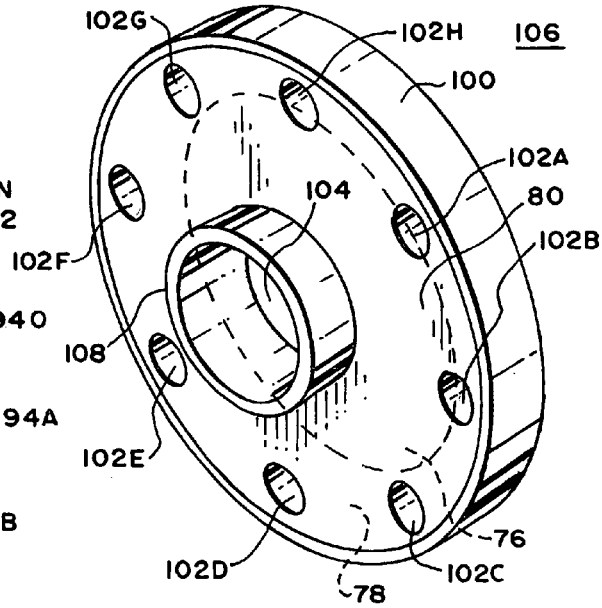
FIG. 14 is a simplified perspective view of a compression ring in accordance with an embodiment of the invention.

In FIG. 14, there is shown a simplified perspective view of a compression ring 106 having a cylindrical outer wall 100 with a flat bottom 80 (not shown in FIG. 14, see FIG. 15) and a central opening 104. A surface 76 slopes outwardly from a plane 78 and radially inwardly in the plane 78 of the compression ring 106 from a radius slightly inward of an imaginary circle drawn through circumferentially spaced openings 102A-102H ends in an outwardly extending right regular tubular cylinder 108 having at its center the opening 104.

Figure 15:
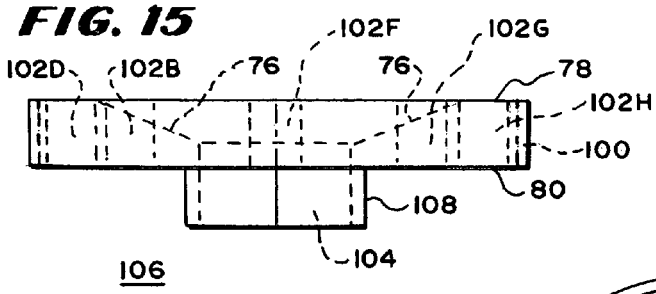
FIG. 15 is a side elevational view of the compression ring of FIG. 14.
Figure 16:
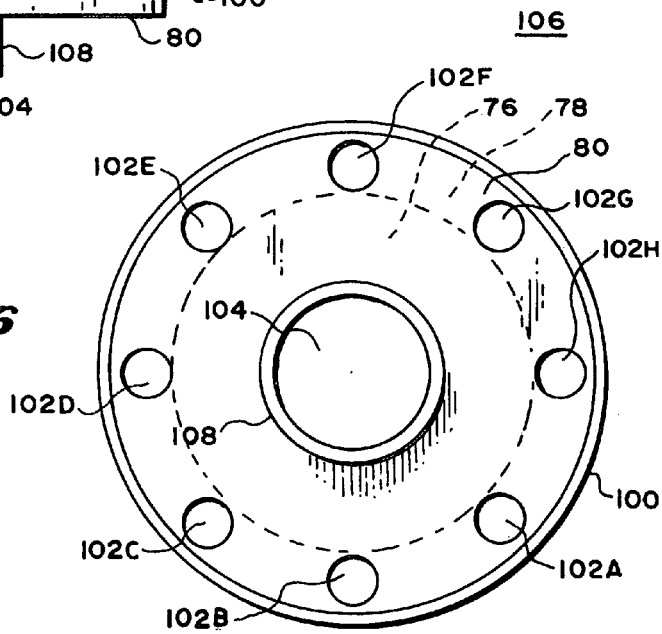
FIG. 16 is a plan view of the compression ring of FIG. 14.

As best shown in FIGS. 15 and 16, the slanted surface 76 slants to the base of the right regular cylinder 108 and at the center is the opening 104 so as to enable the compression ring 106 to fit within the spacer 60 as a separating element and permit the flow of hot gases through the circumferentially spaced right regular cylindrical openings 102A-102H around the central opening 104 for the flow of gas along the second passageway 27 of the second energy spreading section 26.

Figure 17:
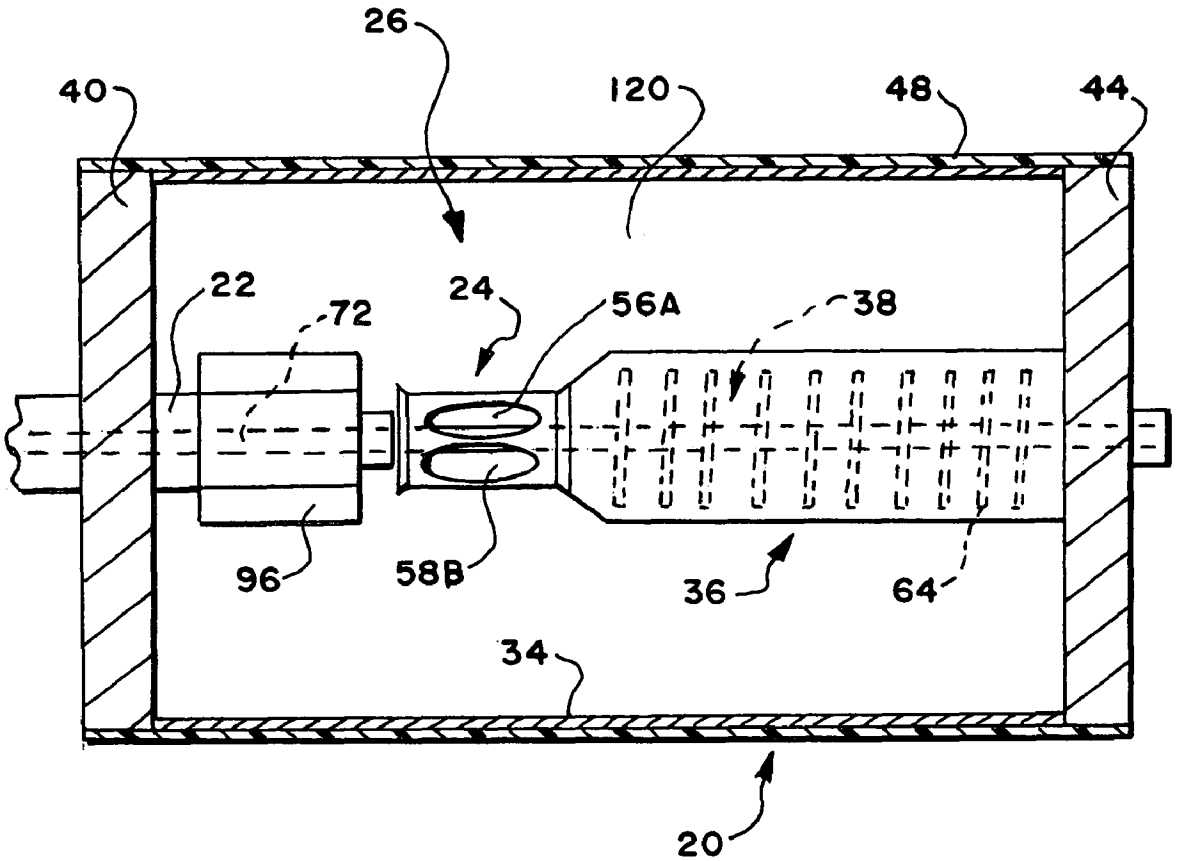
FIG. 17 is a fragmentary, side, elevational view of a suppressor mounted to a barrel with the suppressor partly broken away to show the first and second energy spreading sections.

In FIG. 17, there is shown a fragmentary elevational view of a combination firearm and silencer 28A broken away to show the interior of the silencer 20 having the end of the barrel 22, a coupling fixture 96, a first energy spreading section 24, and a front tube 36 having within it the baffle-spacer combination 38. In the embodiment of FIG. 17, the second energy spreading section 26 includes the tube 36 and a large open space 120 occupying the majority of the interior of the silencer 20. The silencer 20 includes the outer tube 34 and the thermally-conductive wrap 48 about it as well as the front and rear end caps 44 and 42. The passageway 72 for the projectile extends as it must through the coupling 96, first energy spreading section 24 and tube 36 with the hot gases going into the first spreading section 24 and from the first spreading section 24 along the passageway 72 to the tube 36 containing the baffle combination 38 and also through the openings 56, two of which are shown at 56A and 56B in the first energy spreading section 24. As shown in this embodiment, the cylindrical passageway is replaced by a large open space 120 but includes the wrap 48 for rigidity and high thermal conductivity. In another embodiment, the coupling 96, the first spreading section 24 and tube 36 may be omitted entirely so the hot gases are moved entirely into the space 120 where the energy density is reduced and heat is conducted through the outer wall 34 and wrap 48. Moreover, the space 120 and still other embodiments may have entirely different baffles within it so as to provide one energy spacing compartment with a plurality of baffles with a highly thermally conductive wrap 48 about it From the above description, it can be understood that the energy suppressor and/or combination of the energy suppressor and firearm of this invention and the methods of making them have several advantages, such as: (1) they reduce the amplitude of the report of the firearm with a smaller increase in length of the combined firearm and silencer and a small increase in weight; (2) they increase the life of the suppressor by reducing deterioration of the baffles from the hot gases; (3) they improve accuracy and reduce the amplitude of vibrations at the muzzle; (4) they aid in the dissipation of heat and reduce the tendency of the energy suppressor to overheat; and (5) they can be manufactured reliably and predictably with desirable characteristics in an economical manner.

Although a preferred embodiment of the invention has been described with some particularity, it is to be understood that many variations of the embodiment are possible within the light of the above teachings. Therefore, it is to be understood that within the scope of the appended claims, the invention may be practiced other than as specifically described.

What is claimed is:

1. A suppressor for a firearm having a barrel with a muzzle, comprising:

at least first and second energy spreading sections;

said first energy spreading section including a first expansion chamber in communication with said muzzle wherein energy density of gases formed by discharge of the firearm is reduced in said first expansion chamber;

the first expansion chamber including openings coupling the first expansion chamber to said second energy spreading section;

said second energy spreading section including at least first and second passageways;

said first passageway including at least a second expansion chamber;

said second expansion chamber including a front tube and a rear tube;

said second passageway including a series of baffles extending forward of the muzzle;

said rear tube being at least partly mounted to the outer wall of the barrel and said front tube extending forwardly from said muzzle over said second passageway; and said second expansion chamber being in communication with said first expansion chamber and said first expansion chamber being in communication with said muzzle wherein at least some of the gases from the firing of the firearm flow from the muzzle into the first expansion chamber and at least some of the gases from the firing of the firearm flow from the first expansion chamber to the second expansion chamber.

2. A suppressor in accordance with claim 1 in which at least a portion of said first passageway forms a larger coaxial tube about the second passageway; said second passageway being axially located.

3. A suppressor in accordance with claim 1 in which at least a portion of an outer wall of the second expansion chamber includes composite wall portions formed at least partly of at least one of a carbon conductive material and a metallic based material.

4. A suppressor according to claim 3 wherein the conductive material is comprised of a plurality of randomly oriented discontinuous heat conductive fibers embedded in a resin.

5. A suppressor in accordance with claim 1 wherein the series of baffles has an average distance between the baffles and there is a distance between the muzzle and a baffle closest to the muzzle; the distance between the muzzle and the baffle closest to the muzzle being at least twenty percent greater than the average distance between the baffles, wherein gas is cooled before it hits the first baffle.

6. A suppressor in accordance with claim 1 wherein the suppressor has an interior and the second energy spreading section includes a large open space occupying the majority of the interior of the suppressor.

7. A suppressor in accordance with claim 1 wherein at least one of the openings in said first expansion chamber is a radial opening communicating with the first passageway and at least one other of the openings in said first expansion chamber is a central opening communicating with the second passageway;

the ratio of the size of the at least one radial opening to the size of the at least one central opening being selected to control the ratio of the amount of hot gas that flows into the first passageway to the amount of gas that flows into the second passageway, whereby the relative temperatures of the gases in the first passageway and the second passageway is selected.

8. A suppressor in accordance with claim 7 wherein the size of the at least one radial opening is larger than the size of the at least one central opening.

* * * * *